US007891591B1

(12) United States Patent
Hodgson et al.

(10) Patent No.: US 7,891,591 B1
(45) Date of Patent: Feb. 22, 2011

(54) CRACKER CRUMBLER

(76) Inventors: Daniel W. Hodgson, 5771-163 Avenue, Edmonton, AB (CA) T5Y 0A1; Vivian Wimpney, 5771-163 Avenue, Edmonton, AB (CA) T5Y 0A1

( * ) Notice: Subject to any disclaimer, the term of this patent is extended or adjusted under 35 U.S.C. 154(b) by 225 days.

(21) Appl. No.: 12/220,733

(22) Filed: Jul. 28, 2008

Related U.S. Application Data

(60) Provisional application No. 60/962,118, filed on Jul. 27, 2007.

(51) Int. Cl.
*B02C 19/00* (2006.01)

(52) U.S. Cl. ..... 241/30; 241/92; 241/100; 241/285.1

(58) Field of Classification Search ..... 241/92, 241/100, 285.1, 30
See application file for complete search history.

(56) References Cited

U.S. PATENT DOCUMENTS 3,734,417 A 5/1973 Russell et al.
4,113,190 A * 9/1978 Fudman ..... 241/92
4,925,150 A 5/1990 Tedioli
5,022,591 A 6/1991 Sanders
6,830,205 B2 12/2004 Wang
6,830,206 B2 12/2004 Yang
6,948,672 B2 9/2005 Herren
6,966,510 B2 11/2005 Pai
7,007,875 B2 3/2006 Cheng
7,077,347 B1 7/2006 Wang

* cited by examiner

*Primary Examiner*—Mark Rosenbaum
(74) *Attorney, Agent, or Firm*—Montgomery Patent & Design; Robert C. Montgomery

(57) ABSTRACT

An apparatus that crushes and crumbles crackers or similar foodstuffs in preparation for use with various food recipes, is herein disclosed. The apparatus is comprised of a plastic tower approximately two and one-half (2½) inches on a side by eight (8) inches in height. A top cover is removable to load whole crackers thereinto. When the cover is replaced, a switch is activated that energizes a variable speed motor that rotates a plurality of crumbling blades. The blades have serrated or straight edges which crush the crackers. As the crackers are crumbled, the pieces fall into a drawer-like lower compartment. Once the motor is turned off, the base compartment is slid out manually and the cracker pieces are then dispensed into the food dish. Crumbling crackers with such a method allows for cracker crumb consistency for recipes and reduced mess.

19 Claims, 7 Drawing Sheets

CRACKER CRUMBLER

RELATED APPLICATIONS

The present invention was first described in and claims the benefit of U.S. Provisional Patent No. 60/962,118 filed Jul. 27, 2007, the entire disclosures of which are incorporated herein by reference.

FIELD OF THE INVENTION

The present invention relates generally to a food preparation device and, more particularly, to a food preparation device for crumbling foodstuffs, like soda crackers or the like, in a low profile, powered device to provide consistent and uniform crumbs for subsequent use.

BACKGROUND OF THE INVENTION

Crackers are frequently added to food such as soups and chilies. Crackers add taste and consistency to the food. As crackers are not sold in a pre-crushed state, restaurant patrons must crush their crackers at the table. Typically this results in cracker crumbs scattered all over the table and perhaps the nearby floor, but it also results in a wide range of cracker crumb consistency. Accordingly, there exists a need for a means by which crackers may be crumbled in a consistent manner, with little or no mass. The development of the invention herein described fulfills this need.

The cracker crumbler can also be utilized in the preparation of foods such as pie crusts and other recipes that utilize broken soda crackers or cookies. Utilizing the cracker crumbler in these types of recipes would impart an even texture and size to the crumbs created for the recipe.

U.S. Pat. No. 7,077,347 issued to Wang discloses an electric pepper mill. Unfortunately, this patent does not appear to disclose a rechargeable battery operated cracker crumbler.

U.S. Pat. No. 7,007,875 issued to Cheng discloses an electric pepper mill. Unfortunately, this patent does not appear to disclose a rechargeable battery operated cracker crumbler.

U.S. Pat. No. 6,966,510 issued to Pai discloses an electric rotary grater. Unfortunately, this patent does not appear to disclose a rechargeable battery operated cracker crumbler that possesses a crumb container.

U.S. Pat. No. 6,948,672 issued to Herren discloses a spice mill with means for infinitely setting the grinding fineness: Unfortunately, this patent does not appear to disclose a rechargeable battery operated cracker crumbler.

U.S. Pat. No. 6,830,206 issued to Yang discloses an electrically operated grinder for pepper grains, spices, coffee beans or the like. Unfortunately, this patent does not appear to disclose a rechargeable battery operated cracker crumbler that possesses a separate containment section nor does it appear to disclose a variable speed motor.

U.S. Pat. No. 6,830,205 issued to Wang discloses an electric pepper mill that operates when the mill is in the downward position. Unfortunately, this patent does not appear to disclose a rechargeable battery operated cracker crumbler that possesses a crumb container.

U.S. Pat. No. 5,022,591 issued to Sanders discloses a cordless pepper mill. Unfortunately, this patent does not appear to disclose a rechargeable battery operated cracker crumbler that possesses a separate containment section nor does it appear to disclose a variable speed motor and a housing specifically manufactured to accept a stack of crackers.

U.S. Pat. No. 4,925,150 issued to Tedioli discloses an electric grinder for pepper or salt. Unfortunately, this patent does not appear to disclose a rechargeable battery operated cracker crumbler that possesses a crumb container.

U.S. Pat. No. 3,734,417 issued to Russell and Russell discloses an electric pepper mill. Unfortunately, this patent does not appear to disclose a rechargeable battery operated cracker crumbler that possesses a separate containment section nor does it appear to disclose a variable speed motor.

None of the prior art appears to disclose cracker crumbler with a specially designed housing to accept crackers for crumbling, that possesses a rechargeable battery for portability, a cutting assembly to ensure consistent crumbs and that contains a receiving container for the crumbs of the crackers

SUMMARY OF THE INVENTION

In light of the prior art, it is apparent that there is a need for a cracker crumbler that provides a means for automatically crushing and crumbling crackers or similar foodstuffs in preparation for use with various food recipes.

An object of the cracker crumbler is its compact size measuring approximately two-and-one-half (2½) inches on a by eight (8) inches high.

Another object of the cracker crumbler provides for a housing assembly particularly sized to accept a vertical stack of crackers.

A further object of the cracker crumbler is a cutter assembly that provides a motorized rotating mechanism to crush and crumble the crackers.

Yet another object of the cracker crumbler provides is easy cleaning of the cracker crumbler by removal of removable front panel by means of a first handle.

Yet a further object of the cracker crumbler provides is a transparent window that permits the user to visualize the number of crackers inside the cracker crumbler and the amount of crumbs created.

Still a further object of the cracker crumbler provides for a removable top cover that provides top access to an interior space allowing loading of a stack of whole crackers within the assembly.

Yet a further object of the cracker crumbler is an off/on switch that is activated when the top cover is replaced, energizing a motor which turns a cutter disc.

Another object of the cracker crumbler provides for a cutter disc with a plurality of serrated or straight cutting edges which crumble the crackers.

Still another object of the cracker crumbler is a design that permits the crackers once they have been crumbled to accumulate in a removable drawer contained within the lower compartment.

Yet a further object of the cracker crumbler is a crumbler that produces cracker crumbs with a consistent size while avoiding a mess.

Another object of the cracker crumbler is an apparatus that may be powered by rechargeable batteries for increased portability. The cracker crumbler may be recharged using standard household current.

An aspect of the cracker crumbler comprises a housing assembly, a cutter assembly, a base, a battery compartment, an on/off switch, a speed control knob, an AC power cord and a motor.

Another aspect of the cracker crumbler comprises a housing assembly further comprising a plurality of molded or extruded plastic panels and attachments which form a five-sided rectangular box sized to contain a vertical stack of standard square crackers. The housing assembly further comprises a top cover, a front panel, a pair of side panels, a rear panel, and a lower compartment. The housing assembly is made of a rugged plastic material.

A further aspect of the cracker crumbler comprises side panels that provide opposing vertical members to provide enclosure of crackers. The side panels further comprise integral transparent windows so that one can monitor the level of crackers within the housing assembly. The side panels provide a removable attachment means via overlapping edges to a front panel along vertical front edges.

Still another object of the cracker crumbler comprises a top cover comprising a five-sided box-shaped lid having an affixed third cover handle and provides a containment means for crackers.

Yet still another object of the cracker crumbler comprises a lower compartment located at a lower internal portion of the housing assembly further comprising an insertable drawer type crumb container that provides a removably attached dispensing means for cracker crumbs. The lower compartment further comprises a second handle and a pair of compartment windows and utilizes an inclined guide feature located along a front edge of the base for easy opening, removing, and returning the lower compartment.

A further object of the cracker crumbler crumb tray comprises a drawer type device which provides a sliding means for removal of stray cracker crumbs which fall internally within the base portion of the apparatus. The crumb tray is removably attached to a rear panel of the base and slides outward.

Still another object of the cracker crumbler comprises window portions in the side panels that extend from the top cover downward to the lower compartment, providing visual indication of crackers within the housing assembly and crumbs contained in the lower compartment.

Yet a further object of the cracker crumbler comprises a cutter assembly further comprising a cutter frame and a cutter disc. The cutter disc comprises a rotating circular plate located superjacent to the lower compartment. The cutter disc further comprises four (4) first cutter blades and four (4) cutter slots. The cutter disc further comprises gear teeth along a perimeter edge which are driven by a drive gear driven by a motor. The cutter frame provides a housing and circular guidance means for the cutter disc and also provides an attachment means for the cutter assembly to the housing assembly. The cutter frame also provides positional control thereto the cutter disc.

Still yet another object of the cracker crumbler comprises first cutter blades that are affixed along an upper surface of the cutter disc and provide a cutting and crushing means to the loaded crackers. Each first cutter blade further comprises a serrated upper edge having teeth of a particular height and pitch so as to produce cracker crumbs having a desired consistency.

Yet still another object of the cracker crumbler comprises cutter slots that are located adjacent and parallel to the first cutter blades. The crackers when crushed fall through the cutter slots into the lower compartment.

Another object of the cracker crumbler cutter assembly comprises a first bearing surface and second bearing surface. The first bearing surface comprises a recessed cylindrical feature resting upon a first bearing surface, thereby providing vertical and horizontal positioning. The second bearing surface comprises a horizontal protrusion forming a circular shelf providing support to the cutter disc. A food-grade lubricant is to be utilized between the first and second bearing surfaces to reduce friction during use.

Still another object of the cracker crumbler comprises a base that comprises a hollow rectangular foundation to the housing assembly and possesses suitable weight so as to anchor the apparatus during operation. The base comprises a battery compartment, an on/off switch, a speed control, and a removably attachable AC power cord. The on/off switch and speed control are located along a top surface of said base comprising power indicia and speed indicia enabling convenient operation of the apparatus. The base further comprises the lower compartment guide further comprising an inclined surface located along a front edge of the base for easy opening, removing, and returning the lower compartment to a normal position within the housing assembly. The base provides an attachment means to a motor via a pair of standard integral mounting ears. The battery compartment, on/off switch, and the speed control are located at a side portion of the base along an upward horizontal surface.

A further object of the cracker crumbler battery compartment comprises a common flush-mount removable cover made using similar materials as the housing assembly. The battery compartment provides access to one (1) or more rechargeable batteries within the base portion which supply a DC current to the motor.

Still another object of the cracker crumbler on/off switch comprises a 2-position rotary-type switch with power indicia providing a flow of DC electric power to the motor.

Still another object of the cracker crumbler speed control comprises a common miniature rotary rheostat device with speed control indicia providing sufficient current carrying capability to drive the motor in a variable speed manner.

Yet still a further object of the cracker crumbler comprises a rechargeable DC battery system which receives a charging voltage from a removably attachable standard AC power cord with integral AC/DC transformer and male connector which engages the female connector portion of the base along a rear vertical surface.

Still yet another aspect of the cracker crumbler comprises a motor comprising a vertically-mounted commercially available high RPM direct current (DC) electric motor and a drive gear. The drive gear is mounted to the upwardly extending output shaft of the motor and positioned to engage and mesh with the gear teeth along a perimeter region of the cutter disc. The motor and drive gear are discreetly contained within a motor housing which is a protruding molded feature of the rear panel portion of the housing assembly. The motor is a commercially available high revolution DC unit capable of delivering an output speed range of approximately one-thousand (1,000) to five-thousand (5,000) revolutions per minute.

The cracker crumbler, in an alternate embodiment comprises four (4) alternate second cutter blades providing a similar material, construction, and fastening means as the first cutter blades; however, said second cutter blades comprise a sharpened straight upper edge, producing cracker crumbs of a finer consistency.

The method of utilizing the cracker crumbler may be achieved by performing the following steps: locating the apparatus upon a counter or table surface; charging the batteries by connecting the male connector portion of the AC power cord into the female connector; plugging the AC power cord into a common household duplex outlet; allowing a period of time to charge the batteries; removing or allowing the AC power cord to remain connected to the base based upon anticipated usage of the apparatus; preparing the apparatus for crumbling crackers by removing the top cover using the cover handle and the front cover using the first handle; loading a stack of crackers into a top opening of the housing assembly; replacing the front panel, lid, and lower compartment to an installed and closed position; rotating the on/off switch knob to the "ON" position, thereby initiating the crumbling process; adjusting the speed of the motor and cutter disc speed by rotating the speed control knob as required based upon speed control indicator provide the desired crumbling action; monitoring the level of crackers through the compartment windows and side panel windows located along the lower compartment and the side panels, respectively, until such time the crackers are extinguished or when a desired level of cracker crumbs in the lower compartment is obtained; rotating the on/off switch to the "OFF" position to stop the motor; sliding the lower compartment out of the housing assembly and dispensing the cracker crumbs onto a food dish as needed; replacing the lower compartment into the housing assembly; repeating the cracker crumbling process as needed; removing the crumb tray, top cover, and front panel to clean the apparatus as needed; and, benefiting from improved quality and consistency of cracker crumbs being produced in a quick, cleanly, and convenient manner using the cracker crumbler.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | cracker crumbler |
| 15 | housing assembly |
| 16 | cutter assembly |
| 20 | top cover |
| 21 | front panel |
| 22 | side panel |
| 23 | base |
| 24 | lower compartment |
| 25 | rear panel |
| 26 | motor housing |
| 27 | battery compartment |
| 28 | battery |
| 29 | compartment window |
| 30 | first handle |
| 31 | second handle |

-continued

| | |
|---|---|
| 33 | cover handle |
| 34 | window |
| 35 | crumb tray |
| 36 | first bearing surface |
| 37 | guide feature |
| 38 | first flange |
| 39 | second flange |
| 40 | cutter frame |
| 41 | cutter disc |
| 42 | first cutter blade |
| 43 | cutter slot |
| 44 | drive gear |
| 46 | motor |
| 47 | mounting ear |
| 48 | second bearing surface |
| 49 | speed control indicia |
| 50 | on/off switch |
| 51 | speed control knob |
| 52 | alternating current (AC) power cord |
| 53 | internal wiring |
| 54 | female connector |
| 55 | male connector |
| 56 | power indicia |
| 60 | cracker |
| 61 | cracker crumbs |
| 65 | second cutter blade |
| 70 | fastener |

DETAILED DESCRIPTION OF THE PREFERRED EMBODIMENT

Figure 4A:
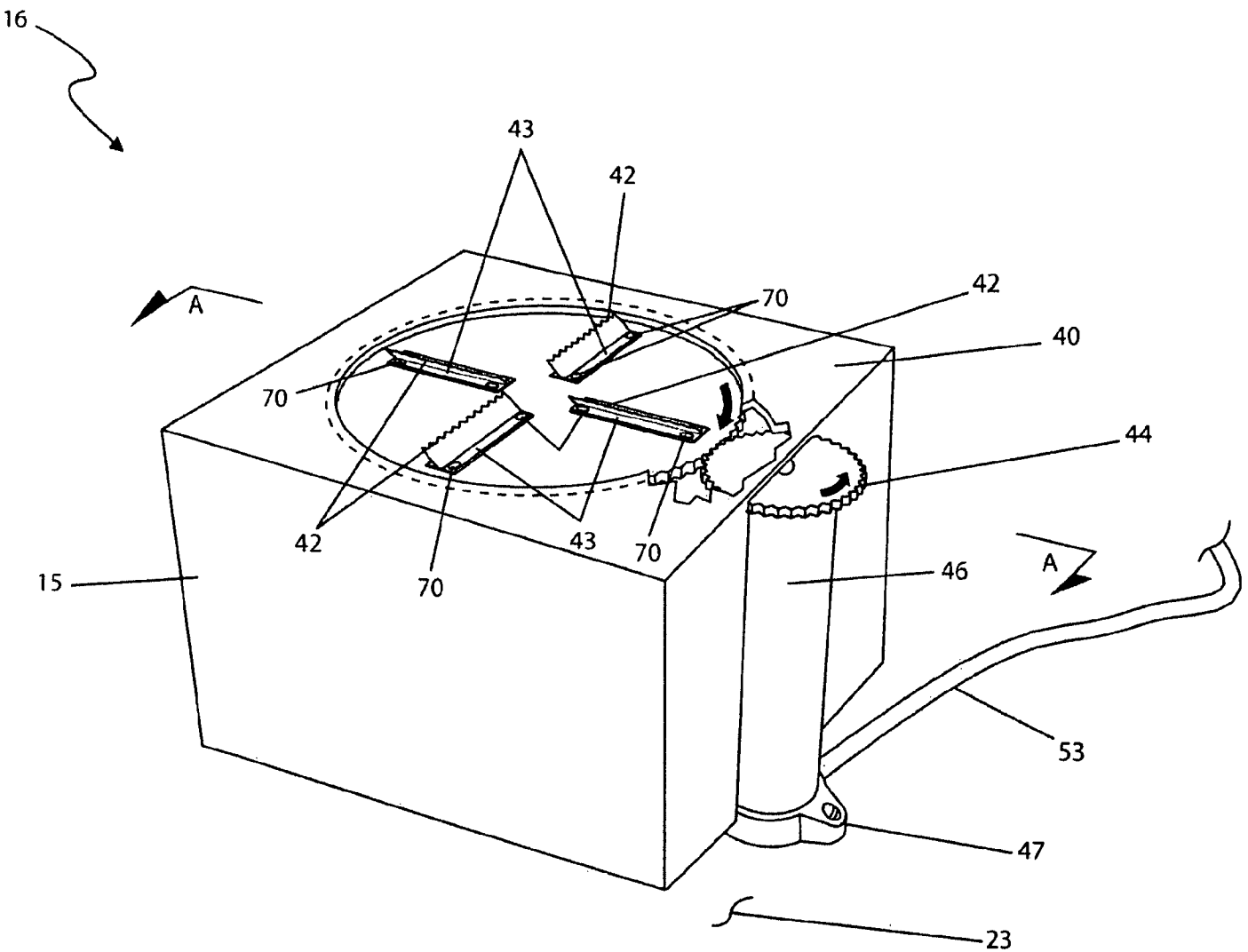
FIG. 4*a* is a perspective view of a cutter assembly portion 16 of a cracker crumbler 10, according to a preferred embodiment of the present invention.
Figure 4B:
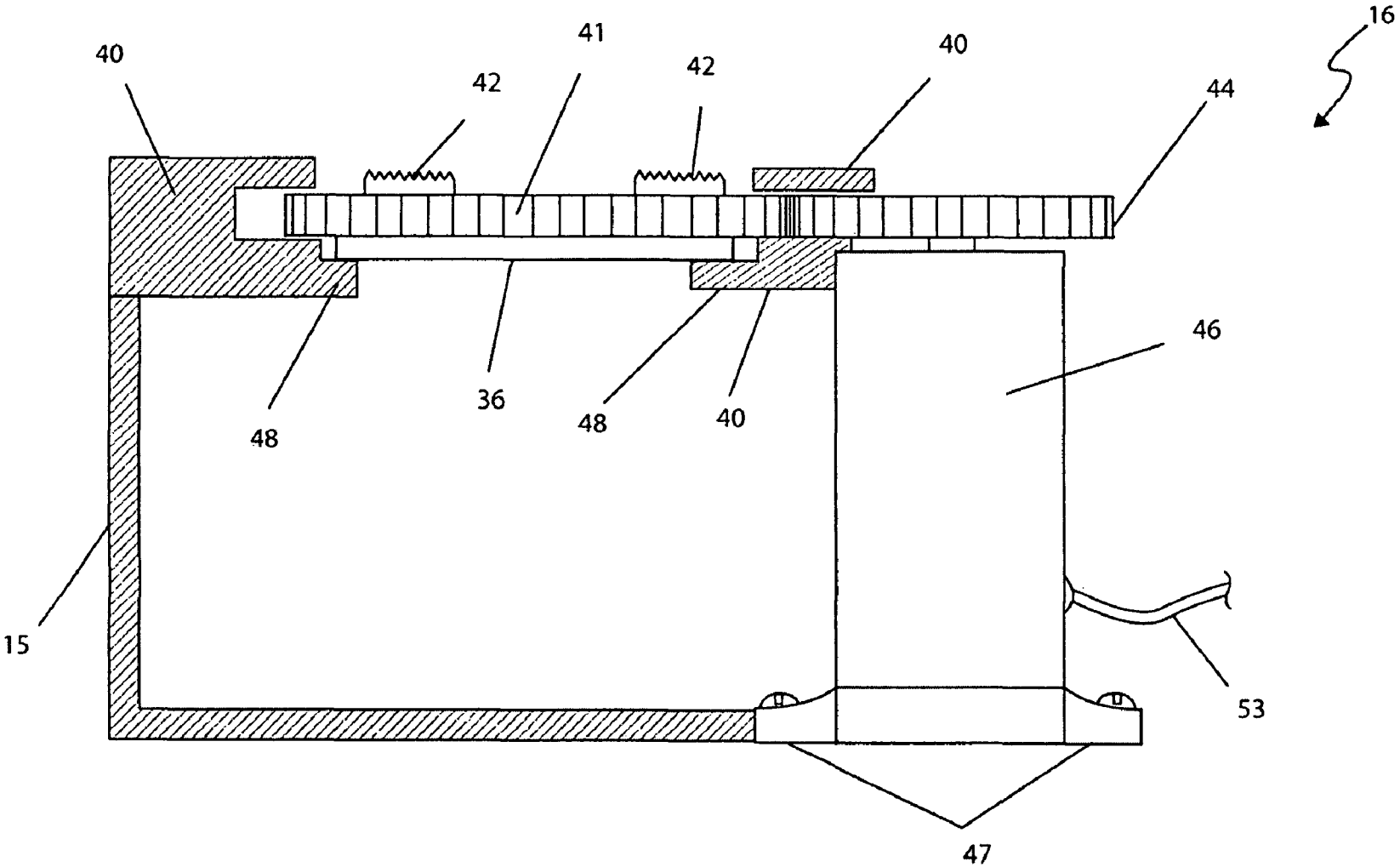
FIG. 4*b* is a section view taken along section line A-A (see FIG. 4*a*) of a cutter assembly portion 16 of a cracker crumbler 10, according to a preferred embodiment of the present invention.
Figure 5:
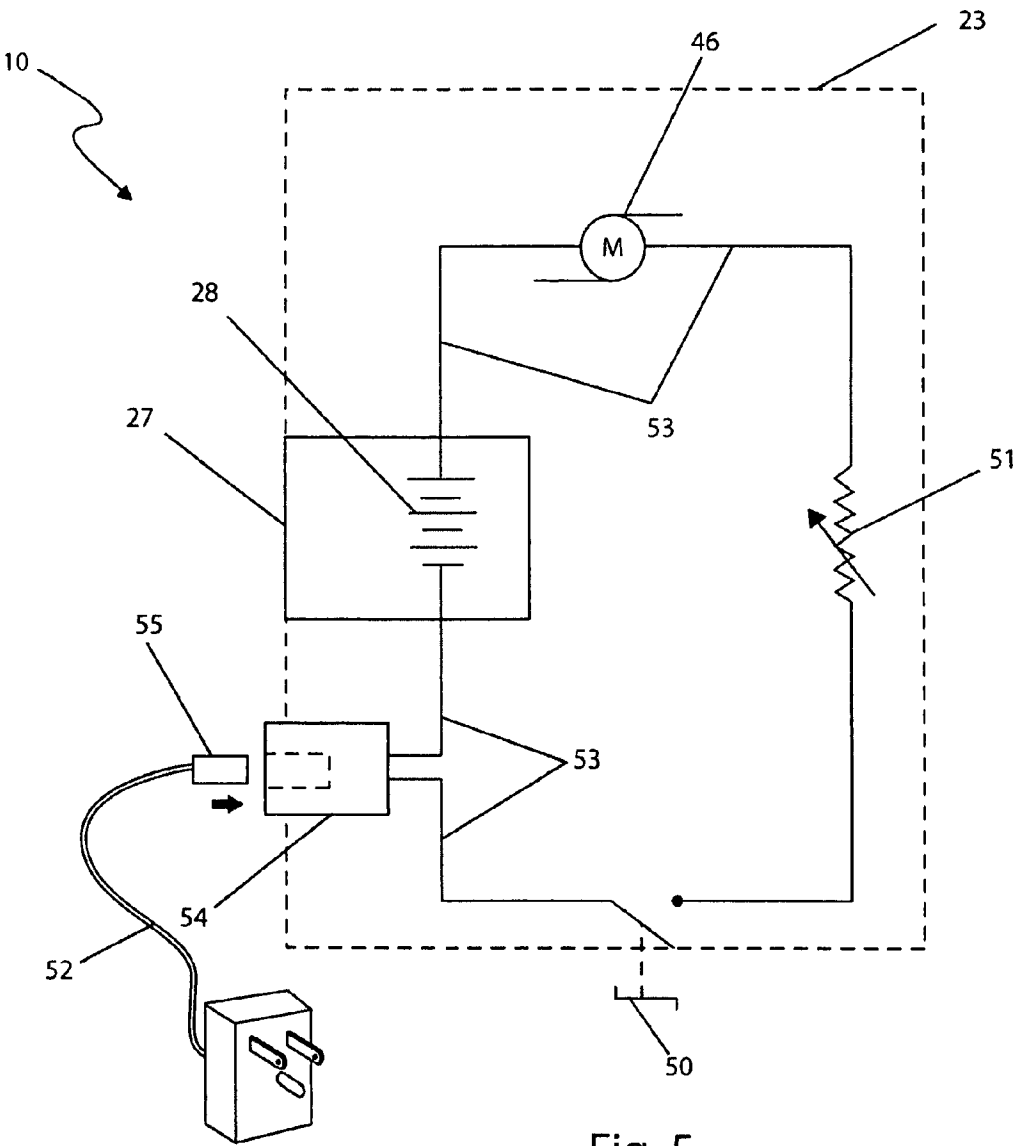
FIG. 5 is an electrical block diagram of a cracker crumbler 10, according to a preferred embodiment of the present invention.
Figure 6B:
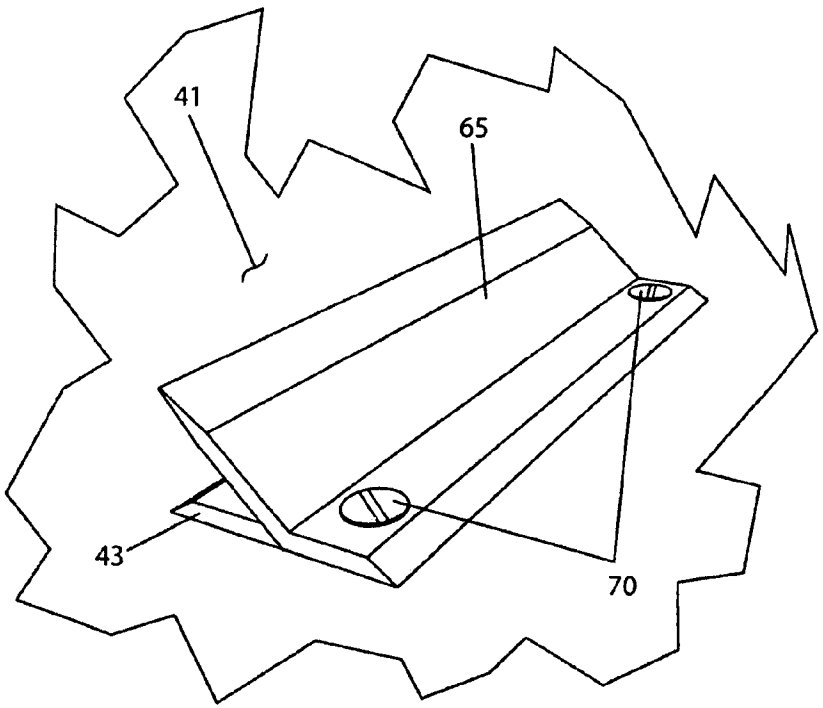
FIG. 6*a* is a close-up view of the first cutter blade portion 42 of the cutter assembly 16, according to a preferred embodiment of the present invention; and, FIG. 6*b* is a close-up view of a second cutter blade portion 65 of the cutter assembly 16, according to an alternate embodiment of the present invention.

The best mode for carrying out the invention is presented in terms of its preferred embodiment, herein depicted within FIGS. 1 through 6*a* and in terms of an alternate embodiment, herein depicted within FIG. 6*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a cracker crumbler (herein described as the "apparatus") 10, which provides a means for automatically crushing and crumbling crackers 60 or similar foodstuffs in preparation for use with various food recipes. The apparatus 10 comprises a plastic housing assembly 15 being approximately two-and-one-half (2½) inches on a side by eight (8) inches high. A removable top cover 20 provides top access thereto an interior space allowing loading of a stack of whole crackers 60 therewithin. When the top cover 20 is replaced, an on/off switch 50 is activated which energizes a motor 46 which turns a cutter disc 41. The cutter disc 41 comprises a plurality of serrated or straight cutting edges which crumble the crackers 60. As the crackers 60 are crumbled, the crumbs 61 fall into a lower compartment 24. Once the motor 46 is switched off, the lower compartment 24 is manually removed and the cracker crumbs 61 subsequently dispensed. Crumbling crackers 60 with such an apparatus 10 produces cracker crumbs 61 having a consistent size while avoiding a mess.

Figure 1:
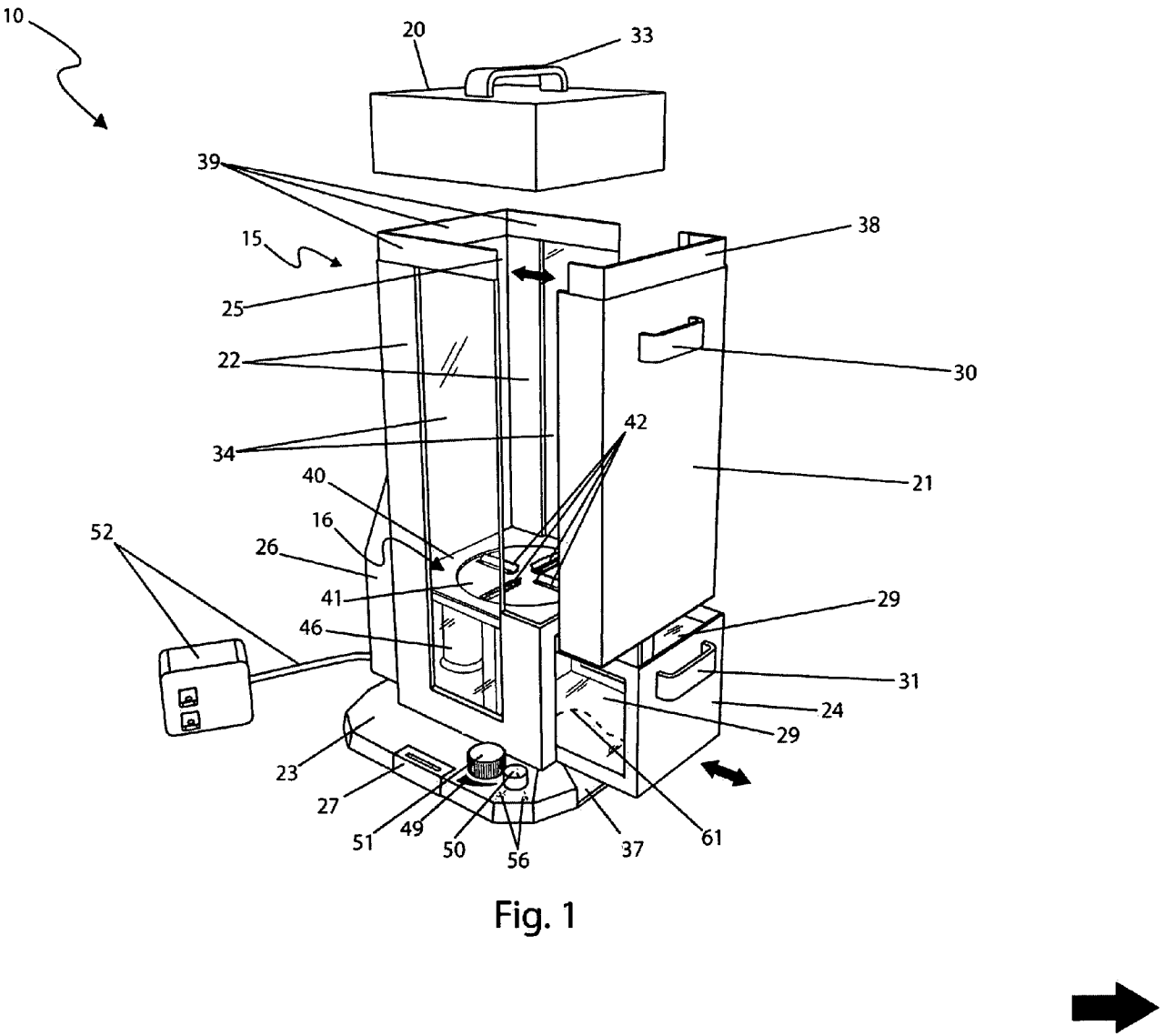
FIG. 1 is an exploded view of a cracker crumbler 10, according to a preferred embodiment of the present invention.
Figure 2:
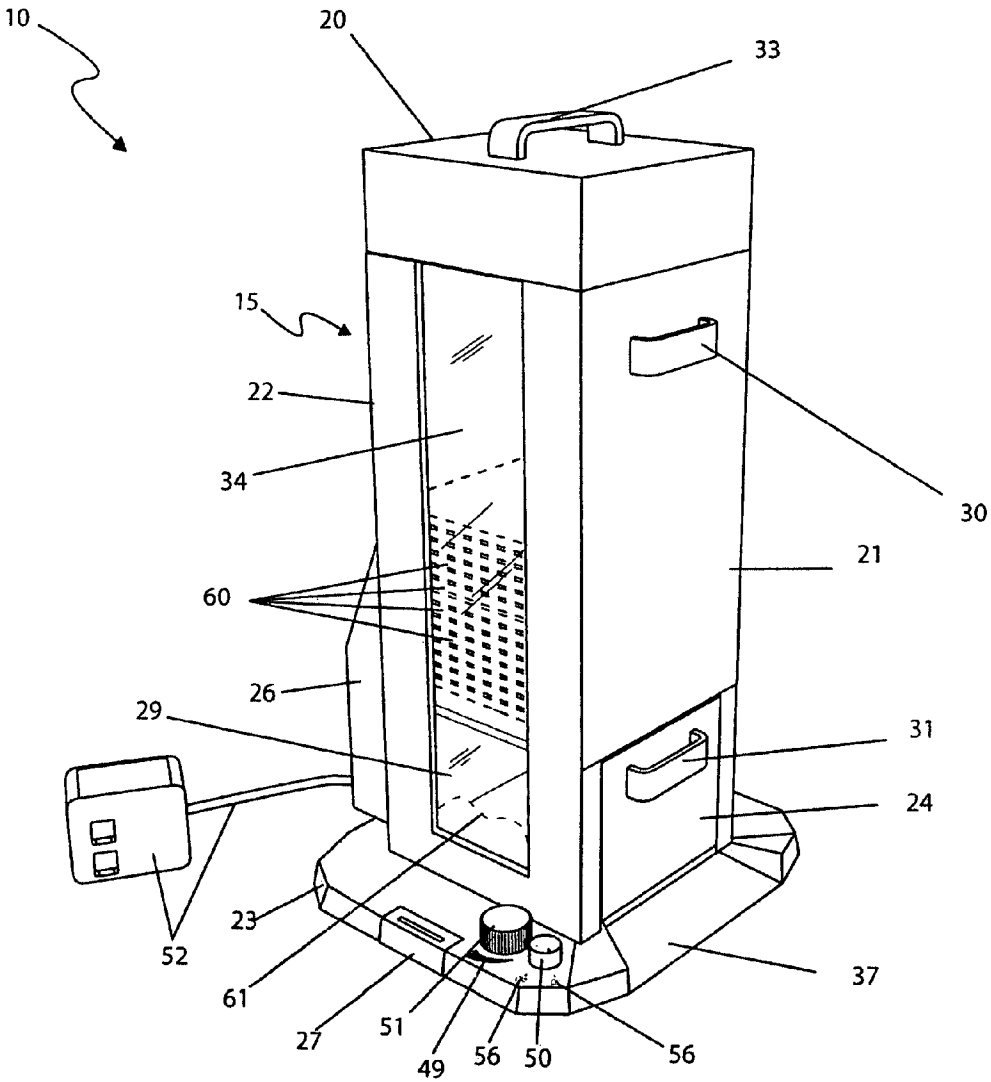
FIG. 2 is a perspective view of a cracker crumbler 10, according to a preferred embodiment of the present invention.

Referring now to FIGS. 1 and 2, exploded and perspective views of the apparatus 10, respectively, according to the preferred embodiment of the present invention, are disclosed. The apparatus 10 comprises a housing assembly 15, a cutter assembly 16, a base 23, a battery compartment 27, an on/off switch 50, a speed control knob 51, and an alternating current (AC) power cord 52. The housing assembly 15 comprises a plurality of molded or extruded plastic panels and attachments which form a five-sided rectangular box particularly sized to contain a vertical stack of standard square crackers 60. The housing assembly 15 further comprises a top cover 20, a front panel 21, a pair of side panels 22, a rear panel 25, and a lower compartment 24. The housing assembly 15 is envisioned to be made using a rugged plastic material such as polypropylene, polyvinylchloride, or the like. The side panels 22 provide opposing vertical members providing enclosure of said crackers 60. The side panels 22 each further comprise integral transparent windows 34, thereby indicating the level of the included crackers 60 within the housing assembly 15. The side panels 22 provide a removable attachment means via overlapping edges thereto a front panel 21 along vertical front edges. The front panel 21 provides a vertical panel being removably attachable via a first handle 30, thereby enabling periodic cleaning of the apparatus 10. The front 21, side 22, and rear 25 panels provide an inserting attachment means thereto the top cover 20 via an upwardly extending and offset first flange 38 and second flange 39 which provides engagement therewith inner surfaces of the top cover 20. The top cover 20 comprises a 5-sided box-shaped lid having an affixed cover handle 33 and provides a containment means for crackers 60 being loaded thereinto the apparatus 10. The top cover 20 engages said first 38 and second 39 flanges in a vertically downward direction. The lower compartment 24 is located at a lower internal portion of the housing assembly 15 comprising an insertable drawer type container providing a removably attached dispensing means for received cracker crumbs 61. The lower compartment 24 further comprises a second handle 31 and a pair of compartment window 29 and utilizes an inclined guide feature 37 located along a front edge of the base 23 for easy opening, removing, and returning said lower compartment 24. The window portion 34 of the side panels 22 extend therefrom the top cover 20 downward to the lower compartment 24, thereby providing visual indication of crackers 60 therewithin the housing assembly 15 as well as crumbs 61 contained therein said lower compartment 24. The cutter assembly 16 provides a motorized rotating mechanism which crushes and crumbles the crackers 60. The cutter assembly 16 further comprises a cutter frame 40 and a cutter disc 41. The cutter disc 41 comprises a rotating circular plate approximately (⅛) to (¼) inch thick in a horizontal orientation being located superjacent to the lower compartment 24. The cutter disc 41 further comprises four (4) first cutter blades 42 and four (4) cutter slots 43. The first cutter blades 42 are affixed along an upper surface of the cutter disc 41 using common fasteners 70 and protrude upwardly providing a cutting and crushing means to the loaded crackers 60. The cutter slots 43 are located adjacent and parallel thereto the first cutter blades 42 being approximately one-eighth (⅛) to one-quarter (¼) inch wide. The crackers 60, when crushed, fall through the cutter slots 43 into the lower compartment 24 below. The cutter disc 41 further comprises gear teeth along a perimeter edge which are driven by a drive gear 44 driven by a motor 46 (see FIG. 3). The cutter frame 40 provides a housing and circular guidance means for the cutter disc 41 and also provides an attachment means for the cutter assembly 16 to the housing assembly 15. The cutter frame 40 provides positional control thereto the cutter disc 41 (see FIG. 4*b*). The base 23 comprises a hollow rectangular foundation to the aforementioned housing assembly 15 and has a suitable weight so as to anchor the apparatus 10 during operation. The base 23 comprises a battery compartment 27, an on/off switch 50, a speed control 51, and a removably attachable AC power cord 52. The on/off switch 50 and speed control 51 are located along a top surface of said base 23 comprising power indicia 56 and speed indicia 49, respectively, thereby enabling convenient operation of the apparatus 10. The base 23 further comprises the lower compartment guide 37 further comprising an inclined surface located along a front edge of the base 23 for easy opening, removing, and returning the lower compartment 24 thereto a normal position therewithin the housing assembly 15.

Figure 3:
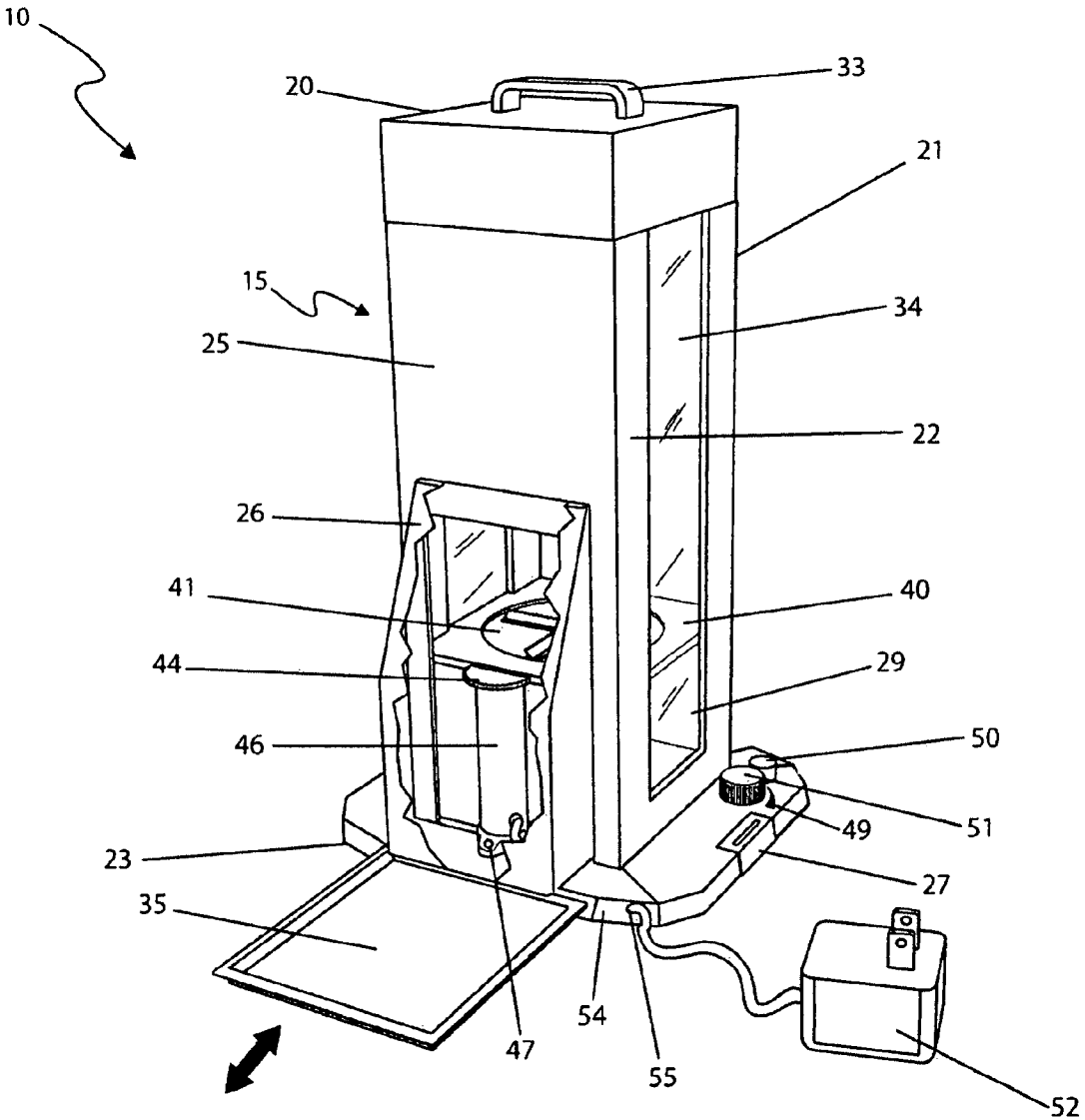
FIG. 3 is a rear cut-away view of a cracker crumbler 10, according to a preferred embodiment of the present invention.

Referring now to FIG. 3, a rear cut-away view of the apparatus 10, according to the preferred embodiment of the present invention, is disclosed. The apparatus 10 comprises a base 23, a battery compartment 27, a crumb tray 35, a motor housing 26, a motor 46, a drive gear 44, a cutter disc 41, an on/off switch 50, a speed control 51, an AC power cord 52, and a female connector 54. The crumb tray 35 comprises a drawer type device which provides a sliding means for removal of stray cracker crumbs 61 which fall internally therewithin the base 23 portion of the apparatus 10. The crumb tray 35 is removably attached to a rear panel of the base 23 and slides outward horizontally and is envisioned to be made using materials similar to the housing assembly 15. The base 23 provides an attachment means to a motor 46 via a pair of standard integral mounting ears 47. The motor 46 comprises a vertically-mounted commercially available high revolutions per minute (RPM) direct current (DC) electric motor 46 and a drive gear 44. The drive gear 44 is mounted thereto the upwardly extending output shaft of the motor 46 and positioned so as to engage and mesh therewith the gear teeth along a perimeter region of the cutter disc 41 (see FIGS. 4*a* and 4*b*). The motor 46 and drive gear 44 are discreetly contained within a motor housing 26 which is envisioned to be a protruding molded feature of the rear panel 25 portion of the housing assembly 15. The battery compartment 27, on/off switch 50, and the speed control 51 are located at a side portion of the base 23 along an upward horizontal surface. The battery compartment 27 comprises a common flush-mount removable cover made using similar materials as the housing assembly 15. The battery compartment 27 provides access thereto one (1) or more rechargeable batteries 28 therewithin the base portion 23 which supply a DC current thereto the motor 46. The on/off switch 50 comprises a 2-position rotary-type switch providing a flow of DC electric power to the motor 46 (see FIG. 5). The speed control 51 also comprises a common rotary switch having speed control indicia providing variable rotating speed of the cutter disc 41. Electric power is provided thereto the motor 46 via a rechargeable DC battery system which receives a charging voltage therefrom a removably attachable standard AC power cord 52 with integral AC/DC transformer and male connector 55 which slidingly engages the female connector portion 54 of the base 23 along a rear vertical surface (see FIG. 5). Operation of the apparatus 10 using said rechargeable DC batteries 28 provides increased portability.

Referring now to FIGS. 4*a* and 4*b*, perspective and section views of the cutter assembly portion 16 of the apparatus 10, according to a preferred embodiment of the present invention, are disclosed. The cutter assembly 16 is illustrated here being isolated therefrom the housing assembly portion 15 for clarity sake. FIG. 4*a* provides a break-away portion of the cutter frame 40 showing engagement thereof the drive gear 44 and gear teeth portion of the cutter disc 41 positioned therearound a perimeter edge. FIG. 4*b* provides a section view of the cutter disc 41 and cutter frame 40 showing a respective first bearing surface 36 and second bearing surface 48. The first bearing surface 36 comprises a recessed cylindrical feature extending downwardly therefrom a lower surface of the cutter disc 41 approximately one-eighth (⅛) inch and resting upon said first bearing surface 48, thereby providing vertical and horizontal positioning thereto. The second bearing surface 48 comprises a horizontal protrusion forming a circular shelf providing support thereto the cutter disc 41. It is envisioned that a food-grade lubricant is to be utilized therebetween the first 36 and second 48 bearing surfaces to reduce friction during use.

Referring now to FIG. 5, an electrical block diagram of the apparatus 10, according to the preferred embodiment of the present invention, is disclosed. The apparatus 10 comprises a common AC/DC appliance circuit shown here. Primary voltage thereto the major electrical components of the apparatus 10 are provided therefrom one (1) or more replaceable DC batteries 28 mounted therewithin the base 23 which receive a charging voltage via a removably attachable AC power cord 52 comprising a male connector 55. Charging of the batteries 28 using standard 110-volt household power is accomplished by inserting the transformer end of the AC power cord 52 thereinto a conventional duplex outlet and inserting the male connector portion 55 therein a corresponding female connector 54 located along the base portion 23 of the apparatus 10. The batteries 28 supply electric power thereto an internal circuit comprising a motor 46, an on/off switch 50, a speed control 51, and internal wiring 53. The on/off switch 50 comprises a common 2-position rotary switch having power indicia 56 which provides a simple circuit closure means thereby conducting a DC voltage therefrom said batteries 28 thereto the motor 46. The speed control 51 comprises a common miniature rotary rheostat device with speed control indicia 49 providing sufficient current carrying capability to drive the motor 46 in a variable speed manner. The motor 46 comprises a commercially available high revolution DC unit capable of delivering an output speed range of approximately one-thousand (1,000) to five-thousand (5,000) RPM's.

Figure 6A:
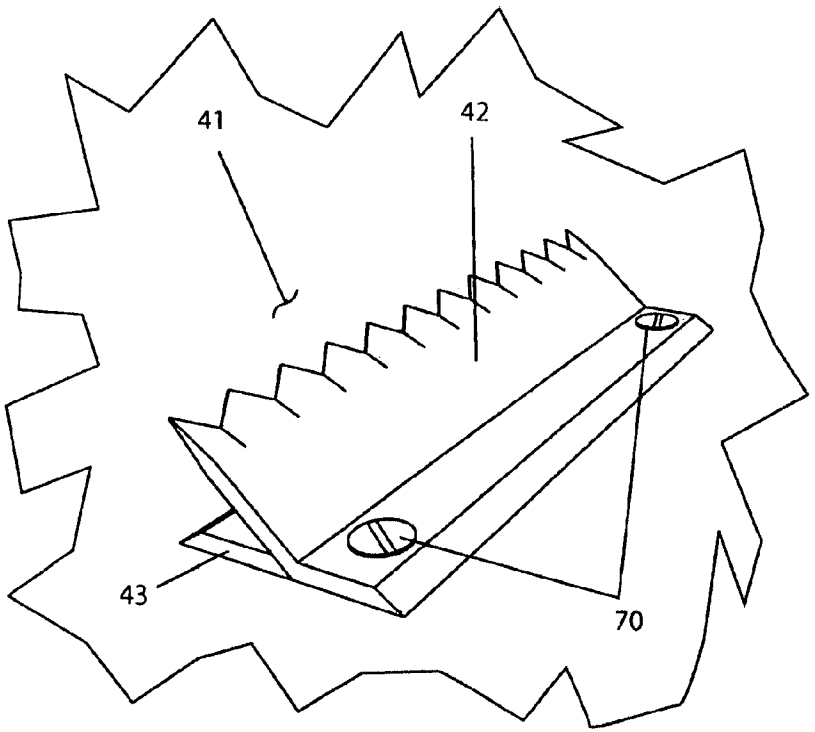

Referring now to FIG. 6*a*, a close-up view of the first cutter blade portion 42 of the cutter assembly 16, according to a preferred embodiment of the present invention, is disclosed. The first cutter blade 42 comprises a linear stainless steel "L" shaped blade being formed at an approximate angle of forty-five degrees)(45° being affixed thereto the cutter disc 41 using common fasteners 70. The first cutter blades 42 extend upwardly, thereby crumbling the crackers 60 during use of the apparatus 10. Each first cutter blade 42 further comprises a serrated upper edge having teeth of a particular height and pitch so as to produce cracker crumbs 61 having a desired consistency.

Referring now to FIG. 6*b*, a close-up view of a second cutter blade portion 65 of the cutter assembly 16, according to an alternate embodiment of the present invention, is disclosed. The apparatus 10 may be alternately manufactured and purchased comprising four (4) alternate second cutter blades 65 providing a similar material, construction, and fastening means as the aforementioned first cutter blades 42; however, said second cutter blades 65 comprise a sharpened straight upper edge, thereby producing cracker crumbs 61 envisioned to have a finer consistency.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of utilizing the apparatus 10 may be achieved by performing the following steps: locating the apparatus 10 upon a counter or table surface; charging the batteries 28 by connecting the male connector portion 55 of the AC power cord 52 thereinto the female connector 54; plugging the AC power cord 52 thereinto a common household duplex outlet; allowing a period of time to charge the batteries 28; removing or allowing the AC power cord 52 to remain connected thereto the base 23 based upon anticipated usage of the apparatus 10; preparing the apparatus 10 for crumbling crackers 60 by removing the top cover 20 using the cover handle 33 and the front cover 21 using the first handle 30; loading a stack of crackers 60 thereinto a top opening of the housing assembly 15; replacing the front panel 21, lid 20, and lower compartment 24 thereto an installed and closed position; rotating the on/off switch knob 50 to the "ON" position, thereby initiating the crumbling process; adjusting the speed of the motor 46 and cutter disc 41 speed by rotating the speed control knob 51 as required based upon speed control indicia 49 to provide the desired crumbling action; monitoring the level of crackers 60 therethrough the compartment windows 29 and side panel windows 34 located along the lower compartment 24 and the side panels 22, respectively, until such time the crackers 60 are extinguished or when a desired level of cracker crumbs 61 therein the lower compartment 24 is obtained; rotating the on/off switch 50 to the "OFF" position to stop the motor 46; sliding the lower compartment 24 out of the housing assembly 15 and dispensing the cracker crumbs 61 onto a food dish as needed; replacing the lower compartment 24 thereinto the housing assembly 15; repeating the cracker crumbling process as needed; removing the crumb tray 35, top cover 20, and front panel 21 to clean the apparatus 10 as needed; and, benefiting from improved quality and consistency of cracker crumbs 61 being produced in a quick, cleanly, and convenient manner using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A crumbling apparatus for grinding and crushing foodstuffs comprising:

a housing assembly comprising a plurality of panels and attachments which form a five (5)-sided rectangular box sized to contain a vertical stack of standard square crackers, further comprising:

a top cover comprising a five (5)-sided lid;

a front panel that provides a vertical panel removably attachable via a first handle located on said front panel thereby enabling periodic cleaning of said apparatus;

a pair of side panels that provide opposing vertical members to provide enclosure of said foodstuffs and provides a removable attachment means via overlapping edges to a front panel along vertical front edges;

a rear panel;

a lower compartment located at a lower internal portion of said housing assembly which is removably attachable to said rear panel of said base; and, a cover handle located on said top cover providing a containment means for said foodstuffs;

a cutter assembly comprising a motorized rotating mechanism which crushes and crumbles said foodstuffs;

a base comprising a hollow rectangular foundation to said housing assembly that possesses suitable weight so as to anchor said apparatus during operation;

a motor comprising a drive gear mechanically connected thereto; and, a motor housing located thereon said housing assembly for containing said motor and said drive gear;

wherein said apparatus provides a means for automatically crushing and crumbling foodstuffs;

wherein said lower compartment provides a means for removing crumbs of said foodstuffs; and, wherein said front panel, said pair of side panels and said rear panel provide an inserting attachment means thereto said top cover via a first flange and a second flange which provides engagement therewith inner surfaces of said top cover.

2. The apparatus of claim 1, wherein said side panels further comprise at least one (1) transparent window thereby allowing a user to monitor the level of said foodstuffs within said housing assembly.

3. The apparatus of claim 1, wherein said lower compartment further comprises:

a second handle; and, a plurality of compartment windows providing visual indication of said crumbs contained therein said lower compartment;

wherein said lower compartment utilizes an inclined guide feature located along a front edge of said base for easy opening, removing, and returning of said lower compartment.

4. The apparatus of claim 1, wherein said cutter assembly further comprises:

a cutter disc that further comprises:

a rotating circular plate located superjacent thereto said lower compartment;

at least one (1) first cutter blade affixed along an upper surface of said cutter disc and provide a cutting and crushing means to said foodstuffs;

at least one (1) cutter slot located adjacent and parallel to said at least one (1) first cutter blades thereby said foodstuffs fall therethrough said at least one (1) cutter slot thereinto said lower compartment;

a plurality of gear teeth located along a perimeter edge which are driven by said drive gear driven by said motor; and, a cutter frame that provides a housing and circular guidance means for said cutter disc, provides an attachment means for said cutter assembly thereto said housing assembly, and provides positional control thereto said cutter disc.

5. The apparatus of claim 4, wherein said cutter assembly further comprises a first bearing surface comprising a recessed cylindrical feature resting thereupon said first bearing surface thereby providing vertical and horizontal positioning; and, a second bearing surface comprising a horizontal protrusion forming a circular shelf providing support to said cutter disc;

wherein a food-grade lubricant is to be utilized between said first bearing surface and said second bearing surface to reduce friction during use.

6. The apparatus of claim 4, wherein said at least one (1) first cutter blade further comprises a serrated upper edge having teeth of a particular height and pitch so as to produce said foodstuffs at a desired consistency.

7. The apparatus of claim 4, wherein said base further comprises:

a battery compartment located at a side portion of said base;

an on/off switch located at a side portion of said base along an upward horizontal surface providing power indicia thereto said apparatus;

a speed control located at said side portion of said base along said upward horizontal surface providing speed indicia thereto said apparatus;

an attachment means thereto said motor via a first standard integral mounting ear and a second standard integral mounting ear;

a removably attachable AC power cord; and, said inclined guide feature of said lower compartment guide further comprising an inclined surface located along a front edge of said base for easy opening, removing, and returning of said lower compartment to a normal position within said housing assembly.

8. The apparatus of claim 7, wherein said battery compartment comprises a removable cover and provides access to one (1) or more rechargeable batteries within said base which supply a DC current to said motor.

9. The apparatus of claim 7, wherein said on/off switch further comprises a two (2)-position rotary-type switch with power indicia providing a flow of DC electric power to said motor.

10. The apparatus of claim 7, wherein said speed control further comprises a rotary rheostat device with speed control indicia providing sufficient current carrying capability to drive said motor in a variable speed manner.

11. The apparatus of claim 7, wherein said apparatus further comprises a rechargeable DC battery system which receives a charging voltage from a removably attachable standard AC power cord.

12. The apparatus of claim 7, wherein said motor is a high revolution DC unit capable of delivering an output speed range of approximately one-thousand (1,000) to five-thousand (5,000) revolutions per minute.

13. The apparatus of claim 7, wherein said housing assembly is approximately two and one-half (2½) inches wide and approximately eight (8) inches high.

14. The apparatus of claim 7, wherein said apparatus further comprises at least one (1) alternate second cutter blade comprising a sharpened straight upper edge thereby producing said crumbs of said foodstuffs in a finer consistency.

15. The apparatus of claim 7, wherein said housing assembly is made of a plastic material, a polypropylene material, or a polyvinylchloride material.

16. The apparatus of claim 7, wherein said cutter disk and said at least one (1) cutter slots are approximately one-eighth (⅛") to approximately one-fourth (¼") in thickness in the horizontal orientation.

17. The apparatus of claim 7, wherein said at least one (1) first cutter blades are affixed thereto said upper surface of said cutter disk using a plurality of fasteners.

18. The apparatus of claim 7, wherein said at least one (1) first cutter blade comprises an "L" shaped blade formed at an approximate angle of forty-five (45) degrees.

19. A method for crushing foodstuffs into granular form utilizing a crumbling apparatus, said method comprising the steps of:

providing said apparatus, comprising:

a housing assembly comprising a plurality of panels and attachments which form a five (5)-sided rectangular box sized to contain a vertical stack of standard square crackers;

a cutter assembly comprising a motorized rotating mechanism which crushes and crumbles said foodstuffs;

a base comprising a hollow rectangular foundation to said housing assembly that possesses suitable weight so as to anchor said apparatus during operation;

a motor comprising a drive gear mechanically connected thereto; and, a motor housing located thereon said housing assembly for containing said motor and said drive gear;

wherein said apparatus provides a means for automatically crushing and crumbling foodstuffs;

locating the apparatus upon a flat surface;

charging the batteries by connecting the male connector portion of the AC power cord into the female connector;

plugging the AC power cord into a common duplex outlet;

allowing a period of time to charge the batteries;

removing or allowing the AC power cord to remain connected to the base based upon anticipated usage of the apparatus;

preparing the apparatus for crumbling crackers by removing the top cover using the cover handle and the front cover using the first handle;

loading a stack of crackers into a top opening of the housing assembly;

replacing the front panel, lid, and lower compartment to an installed and closed position;

rotating the on/off switch knob to the "ON" position, thereby initiating the crumbling process;

adjusting the speed of the motor and cutter disc speed by rotating the speed control knob as required based upon speed control indicator provide the desired crumbling action;

monitoring the level of crackers through the compartment windows and side panel windows located along the lower compartment and the side panels, respectively, until such time the crackers are extinguished or when a desired level of cracker crumbs in the lower compartment is obtained;

rotating the on/off switch to the "OFF" position to stop the motor;

sliding the lower compartment out of the housing assembly and dispensing the cracker crumbs onto a food dish as needed;

replacing the lower compartment into the housing assembly;

repeating the cracker crumbling process as needed; and removing the crumb tray, top cover, and front panel to clean the apparatus as needed.

* * * * *